US008669711B2

(12) United States Patent
Riesebosch

(10) Patent No.: US 8,669,711 B2
(45) Date of Patent: Mar. 11, 2014

(54) DYNAMIC-HEADROOM LED POWER SUPPLY

(75) Inventor: Scott Riesebosch, St. Catherines (CA)

(73) Assignee: CRS Electronics, Ontario (CA)

( * ) Notice: Subject to any disclaimer, the term of this patent is extended or adjusted under 35 U.S.C. 154(b) by 211 days.

(21) Appl. No.: 13/092,651

(22) Filed: Apr. 22, 2011

(65) Prior Publication Data

US 2012/0268013 A1 Oct. 25, 2012

(51) Int. Cl.
*H05B 37/00* (2006.01)
*H05B 39/00* (2006.01)
*H05B 41/00* (2006.01)

(52) U.S. Cl.
USPC ..... 315/192; 315/193; 315/291; 315/294; 315/307

(58) Field of Classification Search
None
See application file for complete search history.

(56) References Cited

U.S. PATENT DOCUMENTS

| | | | |
|---|---|---|---|
| 4,047,049 | A | 9/1977 | Erickson et al. |
| 5,297,013 | A | 3/1994 | Hall et al. |
| 5,977,692 | A | 11/1999 | Itaya et al. |
| 6,836,157 | B2 | 12/2004 | Rader et al. |
| 7,091,874 | B2 | 8/2006 | Smithson |
| 7,196,481 | B2 | 3/2007 | Bushell et al. |
| 7,206,015 | B2 | 4/2007 | Tang et al. |
| 7,269,191 | B2 | 9/2007 | Stewart et al. |
| 7,276,861 | B1 | 10/2007 | Shteynberg et al. |
| 7,286,123 | B2 | 10/2007 | Yang |
| 7,295,176 | B2 | 11/2007 | Yang |
| 7,414,370 | B2 | 8/2008 | Kunjappan |
| 7,492,108 | B2 | 2/2009 | Garcia et al. |
| 7,609,008 | B1 | 10/2009 | Kohler |
| 7,626,346 | B2 | 12/2009 | Scilla |
| 7,635,957 | B2 | 12/2009 | Tripathi et al. |
| 7,656,366 | B2 | 2/2010 | Ashdown |
| 7,663,326 | B2 | 2/2010 | Santo et al. |
| 7,675,250 | B2 | 3/2010 | Chitta et al. |
| 7,701,151 | B2 | 4/2010 | Petrucci et al. |
| 7,733,034 | B2 | 6/2010 | Kotikalapoodi et al. |
| 7,755,303 | B2 | 7/2010 | Johnson et al. |
| 7,768,212 | B2 | 8/2010 | Chen et al. |
| 7,777,424 | B2 | 8/2010 | Hebborn |
| 7,777,430 | B2 | 8/2010 | Catalano et al. |
| 7,786,676 | B2 | 8/2010 | Cheng et al. |
| 7,825,610 | B2 | 11/2010 | Zhao et al. |
| 2004/0032221 | A1 | 2/2004 | Bushell et al. |
| 2006/0186830 | A1 | 8/2006 | Shami et al. |
| 2007/0035538 | A1 | 2/2007 | Garcia et al. |
| 2007/0195527 | A1 | 8/2007 | Russell |
| 2007/0279900 | A1 | 12/2007 | Bauer et al. |
| 2007/0295912 | A1 | 12/2007 | Jurgen et al. |
| 2008/0018261 | A1 | 1/2008 | Kastner |
| 2008/0037239 | A1 | 2/2008 | Thomas et al. |
| 2008/0111505 | A1 | 5/2008 | Wang et al. |

(Continued)

FOREIGN PATENT DOCUMENTS

| | | |
|---|---|---|
| KR | 100779971 | 11/2007 |
| KR | 20070074077 | 12/2007 |

(Continued)

*Primary Examiner* — Anh Tran
(74) *Attorney, Agent, or Firm* — Bingham McCutchen LLP

(57) ABSTRACT

A voltage level supplied to power a plurality of LED light fixtures is dynamically adjusted to control the headroom of the voltage level. The current drawn by at least one of the plurality of LED light fixtures is monitored, and the voltage is increased from zero until the monitored current reaches its maximum.

28 Claims, 4 Drawing Sheets

(56) References Cited

U.S. PATENT DOCUMENTS

| | | | | |
|---|---|---|---|---|
| 2008/0224625 | A1 | 9/2008 | Greenfeld | |
| 2009/0033245 | A1 | 2/2009 | Tsai et al. | |
| 2009/0033248 | A1 | 2/2009 | Cottongim et al. | |
| 2009/0146585 | A1 | 6/2009 | Huang et al. | |
| 2009/0167202 | A1 | 7/2009 | Miskin et al. | |
| 2009/0187925 | A1* | 7/2009 | Hu et al. | 719/327 |
| 2009/0256486 | A1 | 10/2009 | Lai | |
| 2009/0261748 | A1 | 10/2009 | McKinney et al. | |
| 2009/0273301 | A1 | 11/2009 | De Anna et al. | |
| 2009/0289559 | A1 | 11/2009 | Tanaka et al. | |
| 2009/0295292 | A1 | 12/2009 | Harmgardt et al. | |
| 2009/0302770 | A1 | 12/2009 | Weis et al. | |
| 2010/0013395 | A1 | 1/2010 | Archibald et al. | |
| 2010/0013409 | A1 | 1/2010 | Quek et al. | |
| 2010/0045210 | A1 | 2/2010 | Hariharan | |
| 2010/0084994 | A1 | 4/2010 | Kao | |
| 2010/0134049 | A1 | 6/2010 | Matsuoka et al. | |
| 2010/0156315 | A1 | 6/2010 | Zhao et al. | |
| 2010/0164404 | A1 | 7/2010 | Shao et al. | |
| 2010/0194308 | A1 | 8/2010 | Zhao et al. | |
| 2010/0231136 | A1 | 9/2010 | Reisenauer et al. | |
| 2010/0295617 | A1 | 11/2010 | Muentefering et al. | |
| 2011/0068700 | A1* | 3/2011 | Fan | 315/185 R |
| 2011/0227497 | A1* | 9/2011 | Hu et al. | 315/224 |

FOREIGN PATENT DOCUMENTS

| | | |
|---|---|---|
| TW | 1282713 | 7/1994 |
| WO | WO9400965 | 1/1994 |
| WO | WO2007100207 | 9/2007 |
| WO | WO2009022153 | 2/2009 |
| WO | WO2010027254 | 3/2010 |
| WO | WO2010090832 | 8/2010 |

* cited by examiner

DYNAMIC-HEADROOM LED POWER SUPPLY

TECHNICAL FIELD

Embodiments of the invention generally relate to LED lights and, in particular, to multi-fixture LED power supplies.

BACKGROUND

An LED light fixture is a physically distinct housing that contains one or more LEDs arranged in one or more "strings" (i.e., series connections). A room may be lit by multiple LED fixtures arranged at different points on (e.g.) the room's ceiling, and each fixture may have its own power supply to power the one or more strings therein. Each string in a fixture, even if designed to be identical to the other strings, may have different voltage and current requirements from the other strings in the fixture due to, e.g., manufacturing variations or dynamic noise. A power supply serving each string, therefore, must be account for the worst-case string, even if the other strings behave nominally. For example, if the LED strings are designed to require 20 Vdc, the power supply may be required to output 24 Vdc to account for variations in the current/voltage requirements of the strings. Every string that runs at an operating point other than the worst-case (24 Vdc) will, however, waste the additional voltage range, known as "headroom," as heat. In many cases, every string runs at its nominal operating point (20 Vdc), and the entire headroom is wasted.

Some prior-art LED fixtures use a local power supply (i.e., one per fixture) and a technique called dynamic-headroom control to partially address this problem. Because the LED load is known and fixed (i.e., the fixture is manufactured with a certain number of LEDs/strings, and this number does not change) and because each string is directly connected to the local power supply, the power supply may adjust its voltage to reduce the amount of wasteful headroom. For example, the power supply may lower its output voltage until it senses that a string has reached its minimum operating voltage. These prior-art techniques are, however, dependent the power supply designer's a priori knowledge of the size and type of LED load and on direct control/monitoring of each string.

Having a single power supply serving multiple fixtures may be more economical than having a separate power supply for each LED fixture in a room. In this case, the power supply distributes a single power bus to a plurality of fixtures. The savings gained from sharing the power supply, however, may be lost to power wasted to unnecessary headroom applied to the fixtures. Prior-art dynamic-headroom techniques cannot be applied to the multi-fixture LED power supply at least because (i) the multi-fixture LED power supply cannot predict what kind or how many fixtures it will be required to power and (ii) the multi-fixture LED power supply cannot directly monitor or control each fixture (or each string in a fixture). Thus, a need exists for a way to dynamically adjust the headroom in a multi-fixture LED power supply.

SUMMARY

A dynamic-headroom power supply delivers its output voltage to multiple light fixtures. The fixtures and the power supply communicate so that the power supply raises its output voltage just enough so that each LED string is supplied with enough current, but no further. In other words, the power supply dynamically adjusts its voltage headroom to its minimum operable level.

In one aspect, a method dynamically controls headroom of a voltage supplied to a plurality of LED light fixtures. An adjustable voltage is supplied to the plurality of LED light fixtures, and the voltage is increased from zero. A current drawn by at least one of the plurality of LED light fixtures is monitored. The voltage increase is ceased when the current reaches a maximum value.

In various embodiments, the monitored current is drawn by one, some, or all of the plurality of LED light fixtures. The current may be monitored at a location remote to each of the plurality of LED light fixtures. A signal from the plurality of LED light fixtures indicating that all of the plurality of LED light fixtures have reached a maximum current value may be received. A dimming-level signal may be sent to each of the plurality of LED light fixtures. The maximum value of the current drawn by at least one of the plurality of LED light fixtures may be decreased in accordance with the dimming-level signal. Monitoring the current may include monitoring a signal, and the monitored signal may be piggybacked on a power signal, transmitted on a signal bus, or transmitted wirelessly. A reduction in a voltage required to maintain current flow in at least one of the plurality of LED light fixtures may be detected after initial power-up of the system, and the DC voltage of the power bus may be adjusted downward in accordance with the detected reduction. A sudden step change in the total current may be detected, and the DC voltage may be re-adjusted accordingly. The adjustments to the DC voltage may be optimized to deliver just enough voltage on the bus to achieve a desired lighting effect in all of the plurality of LED light fixtures.

In another aspect, a system dynamically controls headroom of a voltage supplied to a plurality of LED light fixtures. An adjustable AC/DC power supply supplies an adjustable DC voltage to a power bus connected to the plurality of LED light fixtures. A sensing circuit monitors a current of at least one of the plurality of LED light fixtures. A control circuit adjusts the DC voltage in accordance with an output of the sensor.

In various embodiments, the sensing circuit includes a current sensor for detecting a maximum current drawn by all of the LED light fixtures and/or a sensor for detecting maximum current drawn by one of the plurality of LED light fixtures. The control circuit may increase the DC voltage until the maximum current drawn by all of the LED light fixtures has been detected and/or until the signal has been received, and may adjust the DC voltage in accordance with the dimming-level signal. A dimming-control circuit may send a dimming-level signal to the plurality of LED light fixtures. The sensing circuit may monitor the current of each of the plurality of LED light fixtures and/or detect, after initial power-up of the system, a reduction in a voltage required to maintain current flow in at least one of the plurality of LED light fixtures; the control circuit may adjust the DC voltage of the power bus downward in accordance with the detected reduction. The sensing circuit may detect a sudden step change in the total current; the control circuit may re-adjust the DC voltage accordingly. The adjustments to the DC voltage may be optimized to deliver just enough voltage on the bus to achieve a desired lighting effect in all of the plurality of LED light fixtures.

In another aspect, a system dynamically controls headroom of a voltage supplied to a plurality of LED light fixture. An adjustable AC/DC power supply supplies an adjustable DC voltage to a power bus connected to the plurality of LED light fixtures. A control circuit induces small changes to the DC voltage on the power bus. A sensing circuit measures correspondingly induced changes in a current of at least one of the plurality of LED light fixtures. The control circuit compares the changes to the DC voltage to the induced changes in the current, thereby determining an operating point of the system, and the control circuit adjusts the DC voltage, if necessary, to position the system at a desired operating point.

In various embodiments, the sensing circuit includes a current sensor for detecting a maximum current drawn by all of the LED light fixtures and/or a sensor for detecting maximum current drawn by one of the plurality of LED light fixtures. The control circuit may increase the DC voltage until the maximum current drawn by all of the LED light fixtures has been detected and/or increase the DC voltage until the signal has been received. A dimming-control circuit send a dimming-level signal to the plurality of LED light fixtures. The control circuit may adjust the DC voltage in accordance with the dimming-level signal.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. In the following description, various embodiments of the present invention are described with reference to the following drawings, in which.

DETAILED DESCRIPTION

Figure 1:
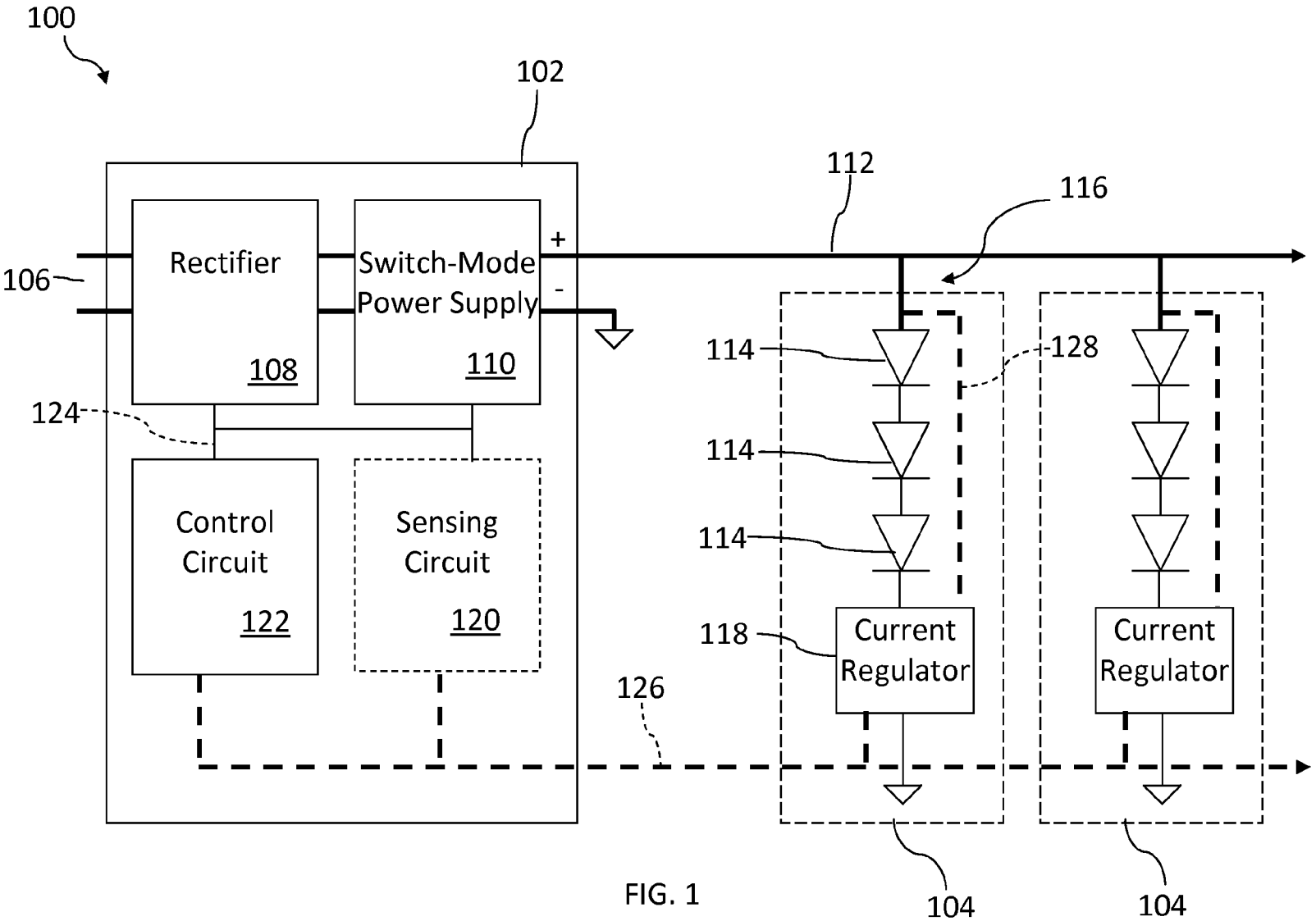
FIG. 1 is a block diagram of a power supply for dynamically adjusting headroom in a multi-fixture environment in accordance with an embodiment of the invention.

FIG. 1 illustrates a lighting system 100 that includes a power-supply unit 102 and a plurality of LED light fixtures 104. The power-supply unit 102 receives an AC input 106 from, for example, an AC mains or a dimmer circuit. The AC signal is rectified by a rectifier 108 and converted to a DC signal by a switch-mode power supply 110, which supplies a DC voltage to a power bus 112. The power bus 112 is connected to the plurality of LED light fixtures 104, which draw power from it in order to emit light. Two fixtures 104 are shown for illustrative purposes; any number of fixtures 104, however, may be used. At least one fixture 104 is located remotely (i.e., physically separate) from the power-supply unit 102, such that connecting more than one or two power and/or control wires between the fixture 104 and power-supply unit 102 would be difficult, impossible, or prohibitively expensive to implement.

Each fixture 104 contains one or more LEDs 114 arranged in one or more strings 116. Each string 116 may include a linear current regulator 118 to control the flow of current through the associated string 116. The current regulator 118 may be any regulator known in the art, such as a sensing resistor and a current-control transistor, for regulating current in LEDs. The regulator 118 monitors the current in the string 116 and prevents it from increasing to a level that might damage the LEDs 114. In the illustrated embodiment, each fixture 104 has a single string 116 of LEDs 114, but a fixture 104 may have any number of strings 116.

In general, the current regulators 118 ensure that the LEDs 114 receive a constant current from the power bus 112, despite any variations in voltage on the power bus 112. The voltage on the power bus 112 must be above a minimum level, however, for the current regulators 118 to function. Due to processing and other variations in the LEDs 114 and/or current regulators 118, however, this required minimum voltage level may vary between strings 116. Any difference between the voltage of the power bus 112 and the required minimum voltage of a string 116 is headroom voltage. The voltage of the power bus 112 may be safely lowered to the level of the string 116 having the greatest minimum required voltage; decreasing the voltage of the power bus 112 past that point will cause at least that string 116 to cease functioning.

The power-supply unit 102 may further include a sensing circuit 120 for sensing a characteristic of the fixtures 104 and a control circuit 122 for adjusting the voltage on the power bus 112 in accordance with the sensed characteristic. The sensing circuit 120 may be a conventional current sensor for sensing the current drawn by one or more of the fixtures 104 and may be implemented using, for example, a digital circuit to sample and measure the current or an analog circuit to compare the current to a reference. As explained further below, the sensing circuit 120 may be disposed in the fixtures 104 and communicate with the power-supply unit 102 via the power bus 112 or signal bus 126; in this embodiment, the power-supply unit 102 includes a signal receiver for receiving communication signals from the fixtures 104.

The control circuit 122 may be an analog, digital, or mixed signal circuit, and may be implemented using an ASIC, microcontroller, low-power processor, or any other circuit known in the art. The control circuit 122 may further include a memory or other volatile or non-volatile storage device. The rectifier 108, switch-mode power supply 110, sensing circuit 120, and/or control circuit 122 may communicate via digital or analog signals sent over an internal bus 124. The power-supply unit 102 may communicate with the LED lighting fixtures 104 via digital or analog signals sent on a dedicated command bus 126 and/or via signals 128 superimposed or piggybacked on the power bus 112 (e.g., an analog data waveform may be combined with the DC voltage on the power bus 112 to transmit data). In other embodiments, the communication may be sent wirelessly or by any other method known in the art. In each case, the signaling may be bi-directional; the power-supply unit 102 sends instructions to the fixtures 104 to modify their behavior (e.g., to dim or brighten the LEDs 114), and the fixtures 104 may send signals to the power-supply unit 102 that carry information regarding a characteristic of the fixtures 104, as explained in greater detail below.

Figure 2:
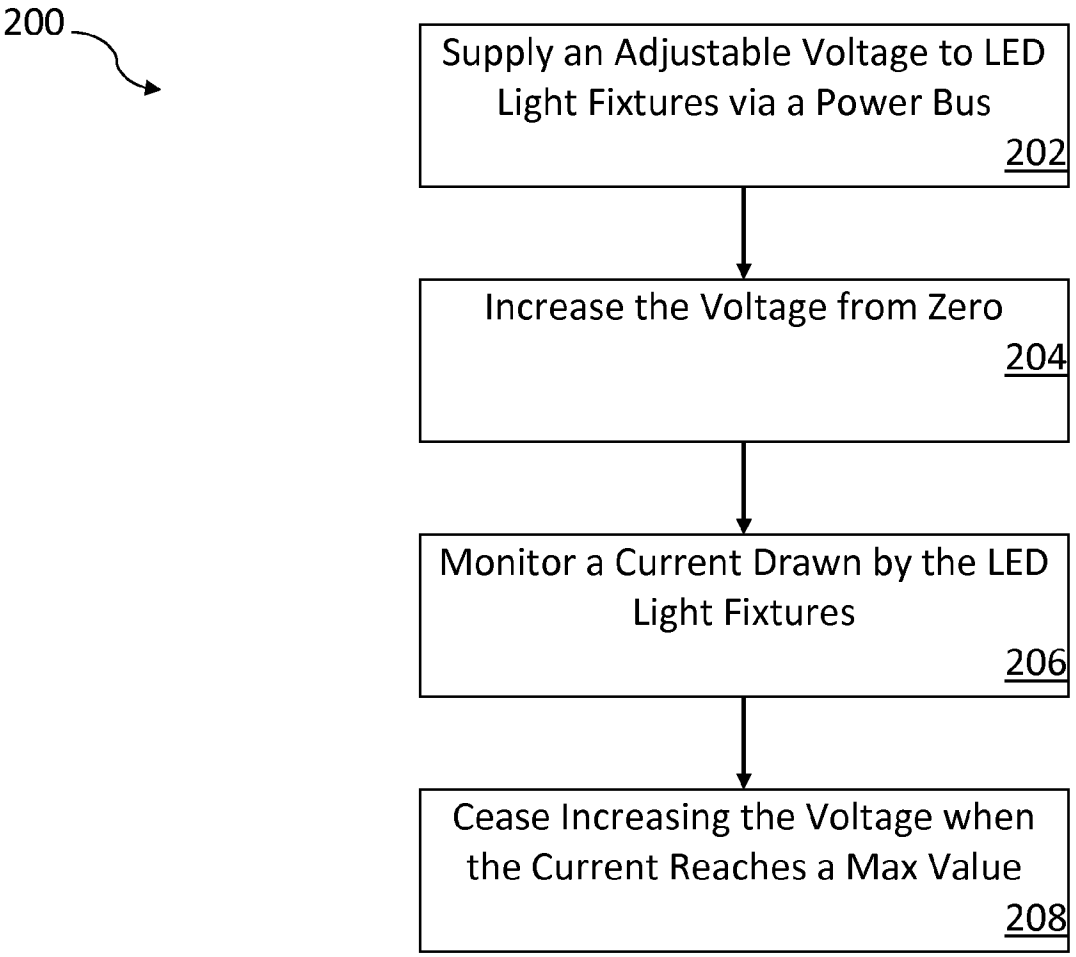
FIG. 2 is a flowchart illustrating a method for dynamically adjusting headroom in a multi-fixture environment in accordance with an embodiment of the invention.

One way of operating the power-supply unit 102 to dynamically adjust the headroom on the power bus 112 supplying power to the fixtures 104 is illustrated in FIG. 2. In a first step 202, an adjustable voltage is supplied to the power bus 112. In a second step 204, the voltage is increased from zero, from near zero, or from any other value below the minimum operating voltage of at least one of the fixtures 104. In a third step 206, the current through the fixtures 104 is monitored at, for example, the power-supply unit 102 as the voltage is increased. In a fourth step 208, the increasing of the voltage is ceased when the monitored current reaches a maximum value, as explained in greater detail below.

Figure 3:
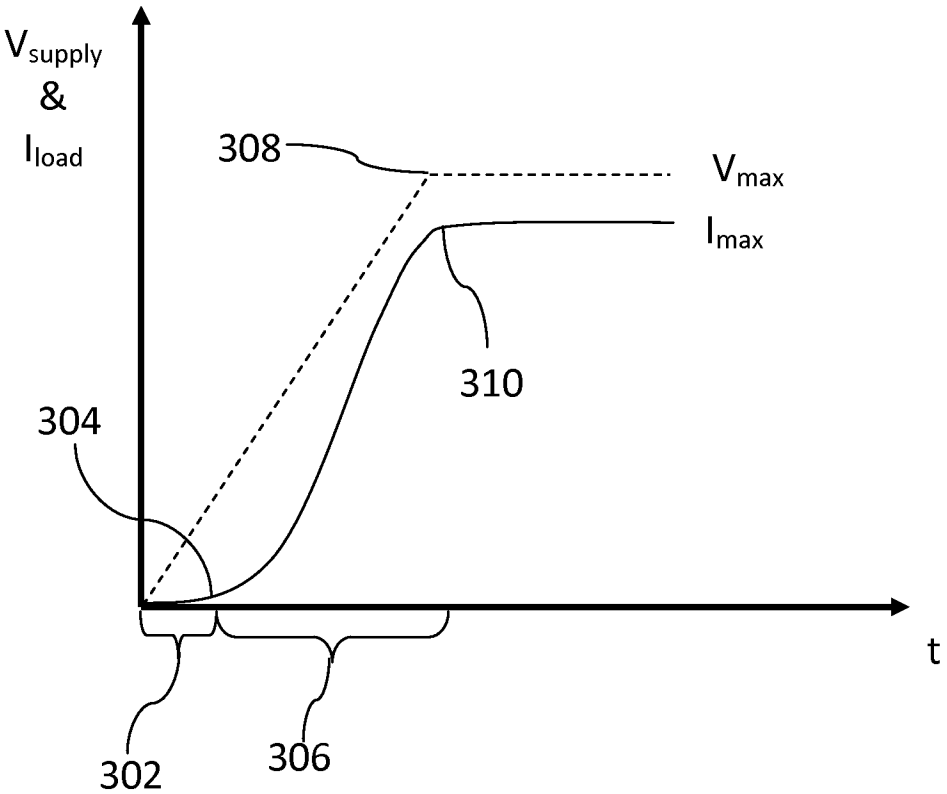
FIG. 3 is a graph illustrating a method for finding a minimum supply voltage in accordance with an embodiment of the invention.

In one embodiment, the monitored characteristic is the total current drawn by the fixtures 104 over the power bus 112. The sensing circuit 120 may monitor this current at the power-supply unit 102 without receiving further feedback from the fixtures 104. In this embodiment, the command bus 126/128 may be unidirectional; the fixtures 104 need not explicitly send signals back to the power-supply unit 102. FIG. 3 illustrates an illustrative relationship between the voltage $V_{supply}$ on the power bus 112 and the total current $I_{load}$ drawn by the fixtures 104. The voltage $V_{supply}$ increases from zero; in a first region 302, the voltage $V_{supply}$ is below the minimum operating voltage of all of the fixtures 104, and no fixture 104 draws any current $I_{load}$. At a point 304, however, at least one fixture 104 turns on and begins to draw current $I_{load}$. As the voltage $V_{supply}$ increases still further into the next region 306, the remainder of the fixtures 104 turn on, further increasing $I_{load}$. In addition, the fixtures 104 already on may draw greater current $I_{load}$ as the voltage $V_{supply}$ increases. Eventually, as $V_{supply}$ increases still further, it will reach a point 308 at which the current $I_{load}$ ceases to increase 310 and assumes it maximum value $I_{max}$. At this point 310, each one of the fixtures 104 has (i) turned on and (ii) reached its maximum current level.

The sensing circuit 120 senses this leveling out of the current $I_{load}$ using techniques known in the art, such as by sampling the current $I_{load}$ drawn over the power bus 112 and comparing the last few samples for differences. Once the differences diminish below a threshold value for a minimum period of time, leveling out is deemed to have occurred. The leveling out of the current $I_{load}$ may be detected within a tolerance such as, for example, a change of less than 1, 5, or 10 milliamps over the course of 10-100 milliseconds. Once the sensing circuit 120 detects the leveling out of the current $I_{load}$, the voltage $V_{supply}$ used 308 (i.e., $V_{max}$) at that point is saved in, for example, the memory in the control circuit 112. Once saved, the voltage $V_{supply}$ may be held at (i.e., locked down at) the value $V_{max}$ during further operation of the circuit 100. In various embodiments, a new $V_{max}$ value may be computed at a future point in time to account for time-based changes to the fixtures 104 and/or power-supply unit 102; the recomputation may occur at regular intervals or in response to a detected change in the circuit 100. For example, a sudden, unexpected drop in $I_{load}$ may indicate that one of the fixtures 104 has stopped drawing current, and $V_{supply}$ may be increased accordingly to try to re-enable the failing fixture 104.

In another embodiment, the control circuit 122 increases $V_{supply}$ while the sensing circuit 120 monitors the command bus 126 (and/or signals 128 on the power bus 112). In this embodiment, each fixture 104 includes a sensing circuit for detecting when that fixture 104 (and/or a string 116 in the fixture 104) reaches a maximum drawn current level and outputs a signal indicative of this condition onto the command bus 126/112/128. The power-supply unit 102 includes a signal receiver capable of detecting the first such signal and ceases increasing $V_{supply}$ when it is received. It may be assumed that the variation in characteristics between the various fixtures 104 and/or strings 116 is small enough such that, by the time $V_{supply}$ is high enough for one fixture 104 to have reached its maximum current, $V_{supply}$ is at least high enough for the remainder of the fixtures 104 to have at least turned on. In another embodiment, the sensing circuit 120 monitors the command bus 126 and/or signals 128 on the power bus 112 for an indication that all of the fixtures 104 (and/or all of the LEDs in each fixture 104) have reached a maximum current value.

Figure 4:
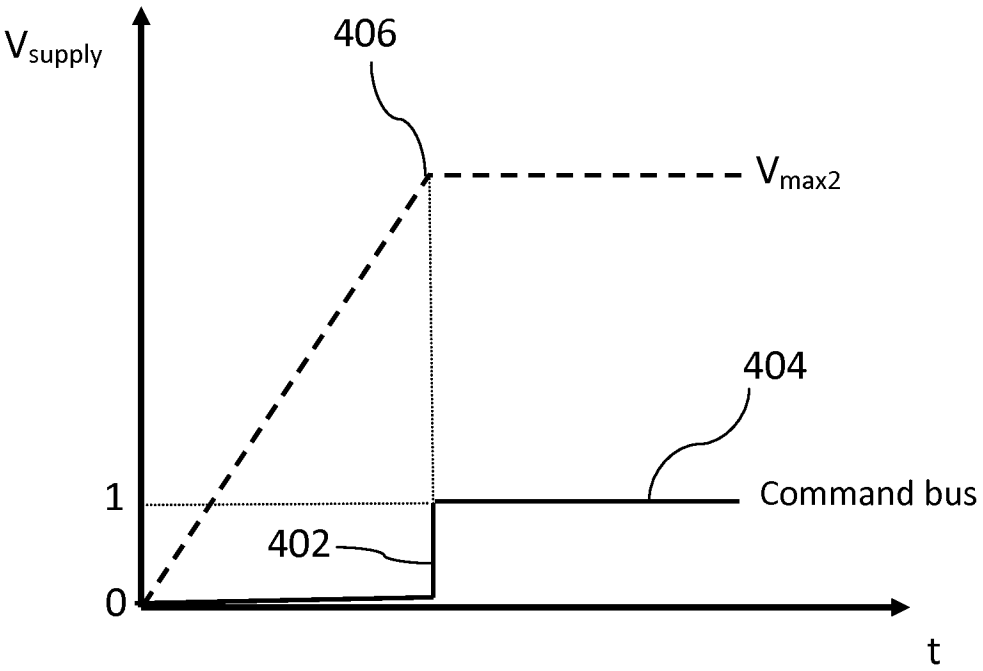
FIG. 4 is a graph illustrating another method for finding a minimum supply voltage in accordance with an embodiment of the invention.

An example of this relationship is illustrated in FIG. 4. $V_{supply}$ increases until it detects a change 402 in a signal 404 from one of the fixtures 104. At this point 406, $V_{supply}$ stops increasing and assumes a maximum value $V_{max2}$. Given an identical set of fixtures 104 and strings 116, and given identical conditions, the current-sensing method described with reference to FIG. 4 will produce a maximum voltage $V_{max2}$ that is less than the maximum voltage $V_{max}$ produced using the method described above with reference to FIG. 3. As described above, $V_{max}$ is reached when every fixture 104 and/or string 116 has reached its maximum current value, whereas $V_{max2}$ is reached when only the first fixture 104 and/or string 116 has reached its maximum current value.

As shown in FIG. 4, the signal 404 is a digital signal that changes, as indicated at 402, from a 0 value to a 1 value. In other embodiments, the signal 404 may be an analog signal or any other means of signaling known in the art. As described above, the signal 404 may be sent via a dedicated command bus 126, over the power bus 112, or wirelessly as desired. In one embodiment, $V_{supply}$ increases until more than one, but fewer than all, of the fixtures 104 send back a signal indicating they have reached maximum current draw. In this embodiment, the final voltage $V_{max2}$ may be greater than necessary to power all of the fixtures 104, but may provide a more robust system 100 if, for example, the amount of noise in the system 100 changes in the future and reduces $V_{supply}$ to a level not experienced during the initial calibration process.

In one embodiment, the power-supply unit 102 sends a dimming-level signal to the plurality of fixtures 104. The dimming-level signal may be sent on the command bus 126 or be piggybacked on the power bus 112 (or wirelessly as noted above). Each fixture 104 may receive the dimming-level signal and use it to modify a dimming level of the LEDs 114 incorporated therein. The power-supply unit may modify the voltage on the power bus 112 in accordance with the modified dimming level—either to increase it to account for a greater current drawn by brighter LEDs 114 or to lower it to save power when the LEDs 114 are dimmed. In one embodiment, the voltage on the power bus 112 varies in order to help achieve a desired dimming level. The fixtures 104 may send a signal back to the power-supply unit 102 when the voltage on the power bus 112 has reached its new operating point by, for example, detecting a maximum current level of one or more of the fixtures 104.

In one embodiment, the LED fixtures 104 require a greater voltage (e.g., 20 V) on the power bus 112 upon initial power-up of the system 100 to achieve the minimum current required for the current regulators 118 to function. Once the LEDs in the fixtures 104 warm up, however, their minimum required voltage may decrease, and the LEDs may reach a steady-state operating point at which their minimum required voltage stabilizes at a value lower than its initial value. The sensing circuit 120 may detect this lower voltage requirement, and the control circuit 122 may lower the voltage on the power bus 112 accordingly (to, e.g., 15 V, 10 V, or lower).

The lower required voltage may be discovered by making small variations in the voltage on the power bus 112. The control circuit 122 varies the voltage and the sensing circuit 120 examines the current drawn by one or more of the fixtures 104 for a corresponding change in current. In one embodiment, the voltage variation is small (e.g., too small to produce a change in the brightness in the LEDs detectable by the human eye). If the voltage is lowered and no corresponding change in current is detected, the lowered voltage is adopted as the new voltage on the power bus 112. In other words, referring to FIG. 3, the point 310 at which $I_{load}$ peaks occurs at a lower voltage $V_{max}$, and the voltage is lowered until a new $V_{max}$ is found. At this point, an increase in voltage does not result in any additional current flow. In one embodiment, the point 310 moves or drifts during operation of the circuit 100, and the control circuit 122 and sensing circuit 120 periodically test the change in current caused by a change in voltage.

In another embodiment, a fixture 104 may be removed from or added to the system 100 (either inadvertently or by design), causing the rest of the fixtures 104 to be over- or under-powered, respectively. The sensing circuit 120 may detect a sudden step change in total current caused by such an event, and the control circuit may re-adjust the voltage on the power bus 112 accordingly. In one embodiment, to reduce the voltage of the power bus 112 may be adjusted to a point that achieves a desired lighting effect from all the fixtures (e.g., a brightness level) by monitoring the total current of all the fixtures.

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. A method for dynamically controlling headroom of a voltage supplied to a plurality of LED light fixtures, the method comprising:

supplying an adjustable voltage to the plurality of LED light fixtures;

increasing the voltage from zero;

monitoring a current drawn by at least one of the plurality of LED light fixtures; and ceasing increasing the voltage when the current reaches a maximum value, wherein the monitored current is drawn by all of the plurality of LED light fixtures and wherein the current is monitored at a location remote to each of the plurality of LED light fixtures.

2. The method of claim 1, wherein the monitored current is drawn by some of the plurality of LED light fixtures.

3. The method of claim 1, wherein the monitored current is drawn by only one of the plurality of LED light fixtures.

4. The method of claim 3, further comprising receiving a signal from the plurality of LED light fixtures indicating that all of the plurality of LED light fixtures have reached a maximum current value.

5. The method of claim 1, further comprising sending a dimming-level signal to each of the plurality of LED light fixtures.

6. The method of claim 5, wherein the maximum value of the current drawn by at least one of the plurality of LED light fixtures is decreased in accordance with the dimming-level signal.

7. The method of claim 1, wherein monitoring the current comprises monitoring a signal.

8. The method of claim 7, wherein the monitored signal is piggybacked on a power signal, transmitted on a signal bus, or transmitted wirelessly.

9. The method of claim 1, further comprising detecting, after initial power-up of the system, a reduction in a voltage required to maintain current flow in at least one of the plurality of LED light fixtures and adjusting the DC voltage of the power bus downward in accordance with the detected reduction.

10. The method of claim 1, further comprising detecting a sudden step change in the total current and re-adjusting the DC voltage accordingly.

11. The method of claim 1, wherein the adjustments to the DC voltage are optimized to deliver just enough voltage on the bus to achieve a desired lighting effect in all of the plurality of LED light fixtures.

12. A system for dynamically controlling headroom of a voltage supplied to a plurality of LED light fixtures, the system comprising:

an adjustable AC/DC power supply for supplying an adjustable DC voltage to a power bus connected to the plurality of LED light fixtures;

a sensing circuit for monitoring a current of at least one of the plurality of LED light fixtures;

a control circuit for adjusting the DC voltage in accordance with an output of the sensor, wherein the sensing circuit comprises a current sensor for detecting a maximum current drawn by all of the LED light fixtures and wherein the current sensor is disposed at a location remote to each of the plurality of LED light fixtures.

13. The system of claim 12, wherein the control circuit increases the DC voltage until the maximum current drawn by all of the LED light fixtures has been detected.

14. The system of claim 12, wherein the sensing circuit comprises a sensor for detecting maximum current drawn by one of the plurality of LED light fixtures.

15. The system of claim 14, wherein the control circuit increases the DC voltage until the signal has been received.

16. The system of claim 12, further comprising a dimming-control circuit for sending a dimming-level signal to the plurality of LED light fixtures.

17. The system of claim 16, wherein the control circuit adjusts the DC voltage in accordance with the dimming-level signal.

18. The system of claim 12, wherein the sensing circuit monitors the current of each of the plurality of LED light fixtures.

19. The system of claim 12, wherein the sensing circuit detects, after initial power-up of the system, a reduction in a voltage required to maintain current flow in at least one of the plurality of LED light fixtures and wherein the control circuit adjusts the DC voltage of the power bus downward in accordance with the detected reduction.

20. The system of claim 12, wherein the sensing circuit detects a sudden step change in the total current and wherein the control circuit re-adjusts the DC voltage accordingly.

21. The system of claim 12, wherein the adjustments to the DC voltage are optimized to deliver just enough voltage on the bus to achieve a desired lighting effect in all of the plurality of LED light fixtures.

22. A system for dynamically controlling headroom of a voltage supplied to a plurality of LED light fixtures, the system comprising:

an adjustable AC/DC power supply for supplying an adjustable DC voltage to a power bus connected to the plurality of LED light fixtures;

a control circuit for inducing small changes to the DC voltage on the power bus; and a sensing circuit for measuring correspondingly induced changes in a current of at least one of the plurality of LED light fixtures, wherein the control circuit compares the changes to the DC voltage to the induced changes in the current, thereby determining an operating point of the system, and wherein the control circuit adjusts the DC voltage, if necessary, to position the system at a desired operating point.

23. The system of claim 22, wherein the sensing circuit comprises a current sensor for detecting a maximum current drawn by all of the LED light fixtures.

24. The system of claim 23, wherein the control circuit increases the DC voltage until the maximum current drawn by all of the LED light fixtures has been detected.

25. The system of claim 22, wherein the sensing circuit comprises a sensor for detecting maximum current drawn by one of the plurality of LED light fixtures.

26. The system of claim 25, wherein the control circuit increases the DC voltage until the signal has been received.

27. The system of claim 22, further comprising a dimming-control circuit for sending a dimming-level signal to the plurality of LED light fixtures.

28. The system of claim 27, wherein the control circuit adjusts the DC voltage in accordance with the dimming-level signal.

* * * * *